US006817544B2

(12) United States Patent
Hanson

(10) Patent No.: US 6,817,544 B2
(45) Date of Patent: Nov. 16, 2004

(54) DEVICE PREVENTING ROTATION OF A POWER DRILL ATTACHMENT

(76) Inventor: John D. Hanson, 2727 De Anza Rd., K18, San Diego, CA (US) 92109

( * ) Notice: Subject to any disclaimer, the term of this patent is extended or adjusted under 35 U.S.C. 154(b) by 0 days.

(21) Appl. No.: 10/336,074

(22) Filed: Jan. 6, 2003

(65) Prior Publication Data

US 2004/0129801 A1 Jul. 8, 2004

(51) Int. Cl.[7] ..... B05B 9/04

(52) U.S. Cl. ..... 239/332; 239/329; 239/331; 239/333

(58) Field of Search ..... 239/332, 329, 239/331, 333; 222/333, 390

(56) References Cited

U.S. PATENT DOCUMENTS

| | | | | |
|---|---|---|---|---|
| 4,712,983 A | | 12/1987 | Moynihan | |
| 4,972,589 A | | 11/1990 | Povleski | |
| 5,839,612 A | | 11/1998 | Burke | |
| 6,398,134 B1 | * | 6/2002 | Hickson et al. | 239/394 |
| 6,488,180 B1 | | 12/2002 | Bayat | |

FOREIGN PATENT DOCUMENTS

| | | | | |
|---|---|---|---|---|
| CA | 2044690 A | * | 12/1992 | B05B/9/01 |

OTHER PUBLICATIONS

Copy of packaging for Drill Powered Fluid Transfer Kit sold by Wayne Water Systems. The Applicant believes that the product illustrated in the packaging has been on sale more than one year prior to the filing date of the present application.

* cited by examiner

*Primary Examiner*—Thomas Denion
*Assistant Examiner*—Zelalem Eshete
(74) *Attorney, Agent, or Firm*—Steven G. Roeder

(57) ABSTRACT

A device for preventing the rotation of a power drill attachment relative to a power drill is provided and is described in combination with a liquid sprayer. The device having a container (10) with a supply tube (12) extending downward into the container (10) and upward into a pump inlet (14) which is open to a pump (16.) The pump (16) has on the rearward side a pump seal (18) and a pump drive (20) and on the forward side a pump outlet (22) and nozzle (24). The pump has a rod (26) affixed to it by means of a rod attachment (28). The rod (26) extends rearward and includes an ergonomic rod pillow (30). Also included is a power drill (36) including a power drill trigger (32) and a power drill chuck (34). When energized the power drill (36) imparts rotational energy to the pump (16). Rotation of the pump (16) relative to the power drill (36) is prevented by the communication of the rod (26) the rod attachment (28) and the housing of the power drill (36).

17 Claims, 2 Drawing Sheets

DEVICE PREVENTING ROTATION OF A POWER DRILL ATTACHMENT

CROSS-REFERENCE TO RELATED APPLICATIONS

This invention uses the centrifugal impeller pump of my co-pending application Ser. No. 10/098,061, Filed 15 Mar. 2002.

BACKGROUND—FIELD OF INVENTION

This invention relates to power drill attachments, specifically to a device to prevent the rotation of a power drill attachment relative to a power drill.

BACKGROUND—DESCRIPTION OF PRIOR ART

Devices for preventing the rotation of power drill attachments are known and are shown for example in U.S. Pat. No. 4,712,983 to Moynihan, U.S. Pat. No. 5,839,612 to Burke and U.S. Pat. No. 6,488,180 to Bayat. In these prior devices a clamping mechanism similar to a hose clamp is affixed to the power drill housing and provides an abutment which prevents the rotation of the power drill attachment relative to the power drill. Such prior devices have a number of disadvantages in that they require the complementary sizing of the clamping mechanism with the power drill housing and the use of tools for constricting the clamp. Also known and shown in U.S. Pat. No. 4,972,589 to Povleski is a means in which the attachment is directly affixed to the drill housing using a threaded fastener which again requires tools and would require a custom housing to receive the fastener. However, power drills typically do not have a housing configuration which permits ease of securing driver attachments. Most conventionally available power drills do not, in fact, provide any specific surfaces on the housing to permit securing of an attachment. Moreover, the configurations of the front portions of known power drills vary widely from manufacturer to manufacturer and from drill to drill with any manufacturer's line of products. A disadvantage thereby arises that there is no universal coupling which is adapted to prevent the rotation of a power drill attachment relative to the power drill. Another disadvantage is known devices involve the use of tools for both the attaching and removal of the drill attachment from the power drill which is time consuming.

SUMMARY

In accordance with the present invention a universal device which prevents the rotation of a power drill attachment relative to a power drill.

OBJECTS AND ADVANTAGES

Accordingly, besides the objects and advantages of the device preventing the rotation of a power drill attachment described above, several other objects and advantages are:

(a) to provide a device which is universal and is easily attached to any power drill, power screwdriver, or any other rotary hand-held power tool.

(b) to provide a device which is universal and can be attached to any power drill without the need for any additional tools.

(c) to provide a device which is universal and can be removed from any power drill without the need for additional tools.

(d) to provide a device which takes no more time to install in any power drill than a standard drill bit thereby saving time and labor.

(e) to provide a device which is inexpensive to manufacture with a minimum of elements.

(f) to provide a device that in combination with a drill sprayer allows one-handed operation.

(g) to provide a device that in combination with a drill sprayer is universally compatible with all commercially available containers.

(h) to provide a device which will prevent rotation of other power drill attachments such as calking guns, air compressors, and screw-shooters.

REFERENCE NUMERALS IN DRAWINGS

Figure 1:
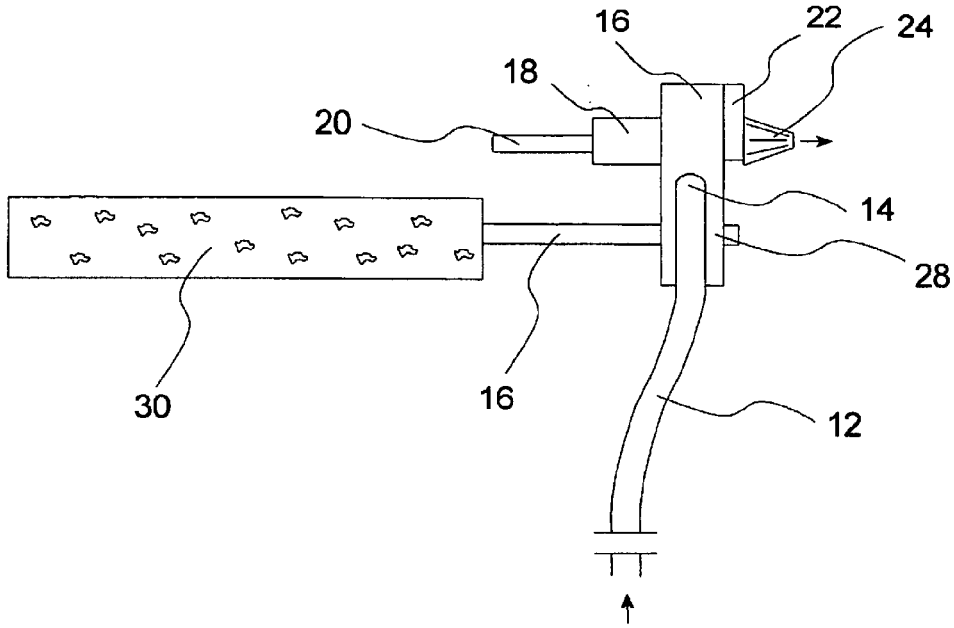
FIG. 1 is a side view of the device not attached to a power drill.

10 liquid container
12 supply tube
14 pump inlet
16 pump
18 pump seal
20 pump drive
22 pump outlet
24 nozzle
26 rod
28 rod attachment
30 rod pillow
32 power drill trigger
34 power drill chuck
36 power drill

DESCRIPTION OF INVENTION

Figure 2:
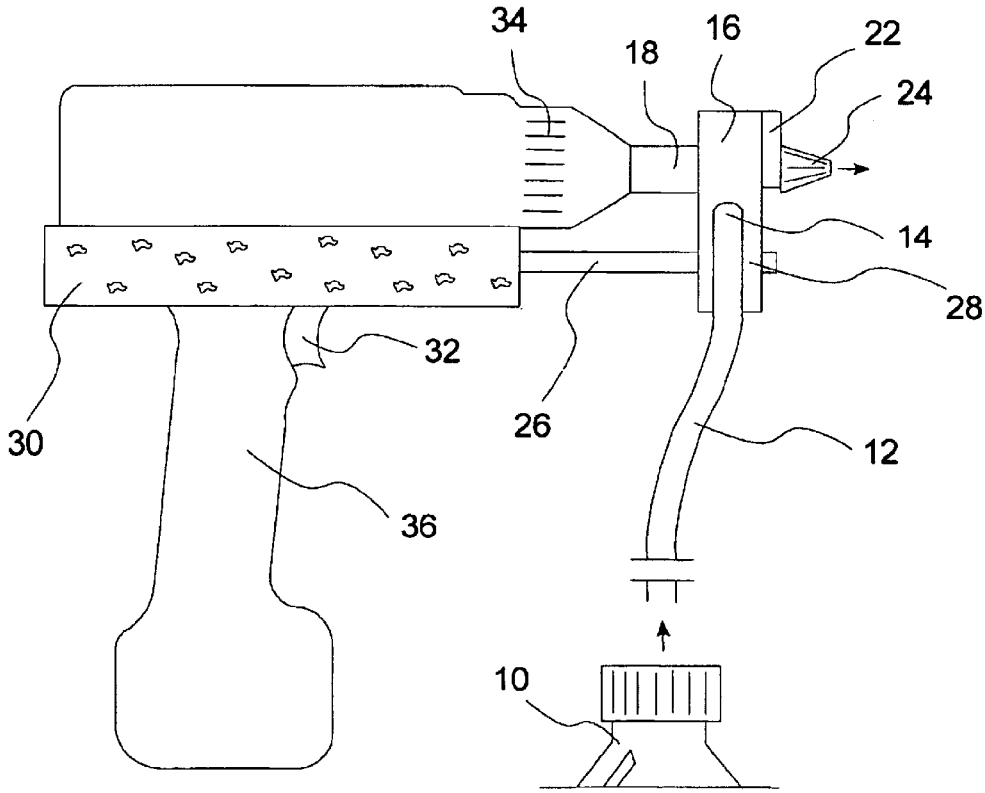
FIG. 2 is a side view of the device attached to a power drill.
Figure 3:
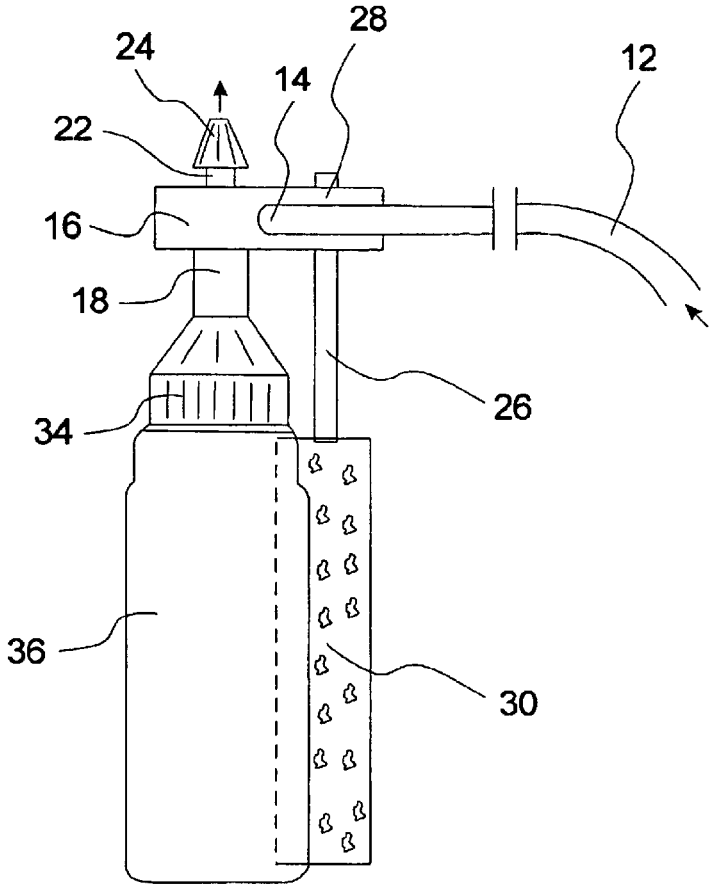
FIG. 3 is a top view.
Figure 4:
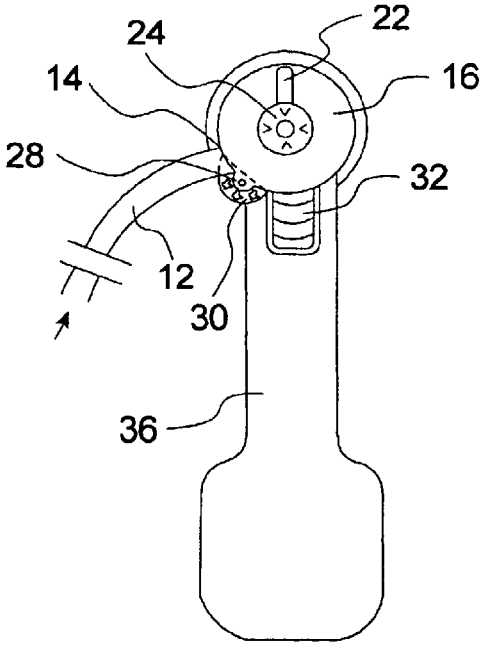
FIG. 4 is a front view.

With reference now to the drawings, and in particular FIGS. 1 through 4 thereof, a new device which prevents the rotation of a power drill attachment relative to a power drill will be described.

The device includes a liquid container 10 with a supply tube 12 which extends downward into the liquid container 10 and upward into a pump inlet 14. The pump inlet 14 is open to a pump 16 which in the drawings is of centrifugal impeller design. Other well known pump types could be employed including gear, piston, vane diaphragm or peristaltic. The back of the pump 16 includes a pump seal 18 and a pump drive 20.

The front of the pump 16 includes a pump outlet 22 which is open to the pump 16 with a nozzle 24 affixed to the pump outlet 22. The nozzle 24 is adjustable from stream pattern through spray pattern and is placed coaxially with the pump drive 20, such placement being critical to elimination of spray stream wobble.

Attached to the pump 16 is a rod 26 which is securely affixed to a rod attachment 28 which in the drawings is of threaded design. The rod 26 is of flexible design and is capable of inward flex to accommodate a small power drill housing and conversely is capable of outward flex to accommodate a large power drill housing. Affixed to the rearward portion of rod 26 is a ergonomic rod pillow 30 which in the drawings is made of sponge rubber or any similar soft cushioning material.

Also included is a power drill 36 having an L-shaped configuration. Such drills are well known and are equipped with an upper extent having a motor mounted therein which communicates with a power drill chuck 34 at the forward extent. A lower extent of the power drill 36 takes the shape of a gripping member with a power drill trigger 32.

The pump 16 is made of a front half-shell and a back half-shell which in the preferred embodiment are permanently bonded together and of all plastic construction. The front half-shell consists of the pump inlet 14, the pump outlet 22, the nozzle 24, and the rod attachment 28. The back half-shell consists of the pump seal 18 and the pump drive 20. When joined the front half-shell of the pump 16 constitutes the outer element and the back half-shell of the pump 16 constitutes the inner element.

OPERATION OF INVENTION

The manner of using the invention is to secure the pump drive 20 in the power drill chuck 34 as a user would do with a drill bit. Holding the power drill 36 in one hand and the container 10 in the other hand the power drill trigger 32 is depressed and rotational energy is imparted through the pump drive 20 and pump seal 18 into the pump 16. When energized the pump 16 creates a pressure differential of several bars. Low pressure is created at the pump inlet 14 and suction draws fluid through the supply tube 12 and into pump 16. High pressure is created at the pump outlet 22 and fluid is forcefully sprayed through the nozzle 24. Rotation of the pump 16 is prevented by the rod 26 which is securely affixed to the rod attachment 28 on the pump 16. The rod 26 extends rearward and is of sufficient length to accommodate the largest power drill 36. Although rotational forces are minimal, the rod 26 has affixed to it a ergonomic rod pillow 30.

CONCLUSION, RAMIFICATIONS, AND SCOPE

As to further discussion the manner of usage and operation of the present device to prevent the rotation of a power drill attachment relative to a power drill, the same should be apparent from the above description. Accordingly, no further discussion relating to the manner of usage and operation will be provided.

With respect to the above description then, it is to be realized that the optimum dimensional relationships for the device and its parts, to include variations in size, materials, shape, form, function and manner of operation, assembly and use are deemed readily apparent and obvious to one skilled in the art, and all equivalent relationships to those illustrated in the drawing and described in the specification are intended to be encompassed herein.

Therefore, the foregoing is considered illustrative only of the principles of the device. Further, since numerous modifications and changes will readily occur to those skilled in the art, it is not desired to limit the device to the exact construction and operation shown and described, and accordingly, all suitable modifications and equivalents may be resorted to, falling within the scope of the invention.

I claim:

1. A liquid sprayer comprising:

(a) a liquid container, (b) a supply tube, (c) said supply tube extending into said container, (d) a pump, (e) a pump inlet open to said pump and of correct size for affixing said supply tube to said pump, (f) a pump drive entering said pump from the rear, (g) a pump outlet and a nozzle affixed to the front of said pump, (h) a rod and means of affixing said rod to said pump, (i) a power drill including a power drill trigger and a power drill chuck, (j) said power drill chuck removably attached to said pump drive, (k) said rod extending rearward from said pump substantially beyond a housing of said power drill, and (l) said rod being adjacent to the housing of said power drill and movable relative to said power drill when the pump drive is coupled to the drill chuck; wherein rotation of the drill chuck in a first rotational direction causes the rod to engage the power drill in a first location and rotation of the chuck in a second rotational direction causes the rod to engage the power drill in a second location.

2. The liquid sprayer of claim 1 wherein said nozzle is removably affixed to said pump outlet and placed coaxially with said pump drive.

3. The liquid sprayer of claim 1 further including a ergonomic rod pillow affixed to said rod.

4. A pump assembly for use with a power drill having a drill housing and a drill chuck that rotates relative to the drill housing, the pump assembly selectively removing a fluid from a container, the pump assembly comprising:

a pump housing including a fluid inlet in fluid communication with the fluid in the container;

a nozzle coupled to the pump housing; and a pump drive that is coupled to the drill chuck and the pump housing, wherein rotation of the drill chuck results in rotation of the pump drive and wherein rotation of the drill chuck relative to the pump housing results in movement of the fluid from the container to the nozzle; and wherein when the pump drive is coupled to the drill chuck, the pump housing selectively engages the drill housing to inhibit rotation of the pump housing relative to the drill housing during rotation of the pump drive and wherein rotation of the drill chuck in a first rotational direction causes the pump housing to directly engage the drill housing in a first location and rotation of the drill chuck in a second rotational direction causes the pump housing to directly engage the drill housing in a second location.

5. The pump assembly of claim 4 wherein the pump housing includes a pump body and an attachment that extends away from the pump body.

6. The pump assembly of claim 5 wherein the attachment includes a flexible rod.

7. The pump assembly of claim 5 wherein the attachment includes an ergonomic rod pillow.

8. The pump assembly of claim 7 wherein the ergonomic rod pillow engages the pump housing.

9. The pump assembly of claim 5 wherein the pump drive and the attachment are substantially parallel.

10. The pump assembly of claim 9 wherein the pump drive and the attachment cantilever away from the pump body in substantially the same direction.

11. A combination for selectively dispensing a fluid from a container, the combination comprising:

a rotary power tool having a tool housing and a chuck that rotates relative to the tool housing; and a dispenser assembly comprising (i) a dispenser housing having a dispenser inlet in fluid communication with the fluid in the container; (ii) a nozzle coupled to the dispenser housing; and (iii) a dispenser drive that is coupled to the chuck and the dispenser housing, wherein rotation of the chuck results in rotation of the dispenser drive and wherein rotation of the dispenser drive relative to the dispenser housing results in movement of the fluid from the container to the nozzle; and wherein the dispenser housing selectively and directly engages the tool housing when the chuck is coupled to the dispenser drive and inhibits rotation of the dispenser housing relative to the tool housing during rotation of the dispenser drive and wherein rotation of the chuck in a first rotational direction causes the dispenser housing to directly engage the tool housing in a first location and rotation of the chuck in a second rotational direction causes the dispenser housing to directly engage the tool housing in a second location.

12. The combination of claim 11 wherein the dispenser housing includes a dispenser body and an attachment that extends away from the dispenser body.

13. The combination of claim 12 wherein the attachment includes a flexible rod.

14. The combination of claim 12 wherein the attachment includes an ergonomic rod pillow.

15. The combination of claim 14 wherein the ergonomic rod pillow engages the dispenser housing.

16. The combination of claim 12 wherein the dispenser drive and the attachment are substantially parallel.

17. The combination of claim 16 wherein the dispenser drive and the attachment cantilever away from the dispenser body in substantially the same direction.

* * * * *